US008984797B2

(12) United States Patent
Ballard

(10) Patent No.: US 8,984,797 B2
(45) Date of Patent: Mar. 24, 2015

(54) ARTICULATING TARGETING DEVICE FOR FIREARMS AND THE LIKE

(71) Applicant: Marlin Daniel Ballard, Austin, TX (US)

(72) Inventor: Marlin Daniel Ballard, Austin, TX (US)

( * ) Notice: Subject to any disclaimer, the term of this patent is extended or adjusted under 35 U.S.C. 154(b) by 143 days.

(21) Appl. No.: 13/747,677

(22) Filed: Jan. 23, 2013

(65) Prior Publication Data

US 2013/0185985 A1 Jul. 25, 2013

Related U.S. Application Data

(60) Provisional application No. 61/632,604, filed on Jan. 27, 2012, provisional application No. 61/632,258, filed on Jan. 23, 2012.

(51) Int. Cl.

| | |
|---|---|
| ***F41G 1/00*** | (2006.01) |
| ***F41G 11/00*** | (2006.01) |
| ***F41G 1/12*** | (2006.01) |
| ***F41G 1/17*** | (2006.01) |

(52) U.S. Cl.

CPC ..... *F41G 1/00* (2013.01); *F41G 11/003* (2013.01); *F41G 1/12* (2013.01); *F41G 1/17* (2013.01)

USPC ..... 42/148; 42/111

(58) Field of Classification Search

CPC ..... F41G 1/00; F41G 1/06; F41G 1/17; F41G 1/02; F41G 1/26; F41G 1/16; F41G 1/08; F41G 1/033; F41G 1/28; F41G 11/003; F41G 1/12

USPC ..... 42/111, 133, 135, 136, 137, 138, 140, 42/147, 148

See application file for complete search history.

(56) References Cited

U.S. PATENT DOCUMENTS

| | | | | | |
|---|---|---|---|---|---|
| 945,366 | A * | 1/1910 | Bernard | 42/137 |
| 1,710,022 | A * | 4/1929 | Hatcher | 42/148 |
| 4,461,087 | A * | 7/1984 | Norman | 42/128 |
| 5,533,292 | A * | 7/1996 | Swan | 42/123 |
| 5,606,818 | A * | 3/1997 | Hardee | 42/124 |
| 6,722,075 | B1 * | 4/2004 | Gabaldon | 42/141 |
| 7,065,916 | B2 * | 6/2006 | Ballard | 42/118 |
| 7,140,142 | B2 * | 11/2006 | Ballard | 42/118 |
| 7,225,576 | B2 * | 6/2007 | Ballard | 42/118 |
| 7,356,962 | B2 * | 4/2008 | Swan | 42/147 |
| 7,367,152 | B2 * | 5/2008 | Samson | 42/128 |
| 7,552,558 | B1 * | 6/2009 | Ballard | 42/111 |
| 7,814,698 | B2 * | 10/2010 | Fluhr et al. | 42/127 |
| 7,814,699 | B2 * | 10/2010 | Storch et al. | 42/137 |
| 8,015,744 | B1 * | 9/2011 | Swan | 42/147 |
| 8,468,735 | B1 * | 6/2013 | Keng et al. | 42/148 |
| 8,490,315 | B2 * | 7/2013 | Dueck | 42/111 |
| 8,510,983 | B2 * | 8/2013 | Larue | 42/148 |
| 8,572,881 | B2 * | 11/2013 | Samson et al. | 42/90 |
| 2006/0162227 | A1 * | 7/2006 | Samson | 42/148 |
| 2012/0060402 | A1 * | 3/2012 | Dueck | 42/137 |
| 2013/0036650 | A1 * | 2/2013 | Larue | 42/148 |
| 2013/0160345 | A1 * | 6/2013 | Li et al. | 42/124 |

* cited by examiner

*Primary Examiner* — Bret Hayes
*Assistant Examiner* — Joshua Freeman
(74) *Attorney, Agent, or Firm* — David O. Simmons

(57) ABSTRACT

An articulating targeting device comprises a mounting base, a swing arm and a sighting component carrying body. The swing arm is pivotably attached to the mounting base for allowing the swing arm to pivot about a first pivot axis between a first swing arm position and a second swing arm position. The sighting component carrying body pivotably attached to the swing arm for allowing the sighting component carrying body to pivot about a second pivot axis between a first carrying body position and a second carrying body position.

13 Claims, 4 Drawing Sheets

ARTICULATING TARGETING DEVICE FOR FIREARMS AND THE LIKE

CROSS REFERENCE TO RELATED APPLICATIONS

This patent application claims priority from U.S. Provisional Patent Application having Ser. No. 61/632,604, filed 27 Jan. 2012, entitled "Flip-out Firearm Sight", having a common applicant herewith and being incorporated herein in its entirety by reference.

This patent application claims priority from U.S. Provisional Patent Application having Ser. No. 61/632,258, filed 23 Jan. 2012, entitled "Flip-out Firearm Sight", having a common applicant herewith and being incorporated herein in its entirety by reference.

FIELD OF THE DISCLOSURE

The disclosures made herein relate generally to sights and targeting devices for firearms and the like and, more particularly, to an articulating targeting device.

BACKGROUND

Typical 'iron' sights, which are unmagnified sighting devices without optics (i.e., mechanical sights), are commonly used in a manner whereby they are mounted permanently or temporarily to the top of a handheld or shoulder-fired firearm. This created a problem if there was a desire to use multiple sighting devices for targeting purposes. In this regard, a sighing device is also referred to herein as a targeting device. The iron sights on some rifles allowed for a scope or other type of sighting device to be mounted on the top of a firearm concurrently with the iron sights. However, when used in this manner, the iron sights became unusable because the shooter's line of vision for the iron sights was visually obscured (i.e., partially blocked) or completely blocked or when the iron sight was mechanically prevented by the optic from being deployed.

As military and law enforcement rifles began to utilize a large number of different sighting devices and accessories, the rear and/or the front iron sight was usually in the way and was either removed or covered by an added targeting instrument (e.g., a scope or other type of sighting device). Therefore, the utility of having iron sights as a back-up or close range sighting device was removed from the firearm and no backup or close range targeting device was available if the added targeting instrument became inoperable or became undesirable for a particular shooting task.

A partial solution to this problem was provided with the development and proliferation of accessory rails for firearms, such as the Picatinny M1913 style of rail. Initially, these accessory rails were mounted on the top of a firearm (i.e., above the barrel and/or receiver body), and later added to many quadrants surrounding the barrel. A variety of targeting devices, including folding iron sights, then came into common usage. However, folding iron sights did not remedy the problem of not being able to see through a magnified scope, holographic sight, or night vision scope if the devices failed or changing shooting requirements necessitated the need for the iron sights. Folding iron sights could be collapsed and moved out of the line of sight of other targeting devices, but the converse was not true. Obviously, an unneeded targeting device could be removed, but that is not usually an option in the heat of combat, especially if the device may be needed again shortly. Repeated removal and re-installing of a targeting device also compounds the problem by risking that the device would no longer be 'zeroed', thereby hampering its accuracy. Additionally, temporary removal and storage of a large unneeded targeting device may be significantly problematic during the intensity of battle.

Therefore, a solution for allowing iron sights to be used in a conjunction with other types of targeting devices in a manner that allows both types of targeting devices to be selectively used without interfering with the other and that allows a front and/or rear iron sight to be conveniently and effectively stowed would be advantageous, desirable and useful.

SUMMARY OF THE DISCLOSURE

An articulating targeting device configured in accordance with the present invention can be used in a conjunction with other types of targeting devices in a manner that allows each of the targeting devices to be used without interfering with the other and that allows an articulating targeting device in the form of an iron sight iron to be conveniently and effectively stowed. More specifically, embodiments of the present invention are directed to a targeting device (e.g., an iron sight for a firearm) that can be selectively articulated between a stowed orientation and a deployed orientation (i.e., an articulating targeting device). Preferably, but not necessarily, an articulating targeting device configured in accordance with the present invention (e.g., a flip-out iron sight) lies on top of, underneath, or to the side of an accessory (i.e., mounting) rail of a firearm when in the stowed orientation and, when needed, can be flipped out to its deployed orientation (i.e., to the side of the accessory rail). In this manner, an articulating targeting device configured in accordance with the present invention advantageously does not compete for space or visual line of sight access on the accessory rail with other targeting devices mounted on top of the accessory rail and does not interfere with use of such other targeting devices whether the articulating targeting devices is in its stowed or deployed orientations.

In one embodiment of the present invention, an articulating targeting device comprises a mounting base, a swing arm and a sighting component carrying body. The swing arm is pivotably attached to the mounting base for allowing the swing arm to pivot about a first pivot axis between a first swing arm position and a second swing arm position. The sighting component carrying body is pivotably attached to the swing arm for allowing the sighting component carrying body to pivot about a second pivot axis between a first carrying body position and a second carrying body position.

In another embodiment of the present invention, an articulating targeting device comprises a mounting base, a sighting component carrying body and an articulation structure coupling the sighting component carrying body to the mounting base. The articulation structure enables the sighting component carrying body to be rotated about a first pivot axis that extends through the mounting base and enables the sighting component carrying body to be rotate about a second pivot axis that extends through the sighting component carrying body.

In another embodiment of the present invention, a targeting device comprises a mounting base, an intermediate body, a sighting component carrying body, means for enabling displacement of the intermediate body with respect to the mounting base and means for enabling displacement of the sighting component carrying body with respect to the intermediate body. The means for enabling selective displacement of the intermediate body is coupled between the mounting base and the intermediate body. The means for enabling selective displacement of the sighting component carrying body is coupled between the intermediate body and the sighting component carrying body.

Although the discussion and descriptions herein are directed to a rear sight, because of primary rear sights creating more positioning and movement constraints for an articulating sight on the rear of a firearm, the discussion and descriptions herein are concerned equally with the mechanisms involved with deploying either or both a front and/or rear sight. It is important to note that the mechanisms used to deploy a firearm sight configured in accordance with the present invention, which is designed to be used on the same firearm, may not utilize the same mechanism to ultimately position the target alignment area of the sight within the shooter's line of sight. In other words, a front sight and a rear sight that are each configured in accordance with an embodiment of the present invention do not need to be constructed in the same manner or style.

These and other objects, embodiments, advantages and/or distinctions of the present invention will become readily apparent upon further review of the following specification, associated drawings and appended claims.

DETAILED DESCRIPTION

Figure 1:
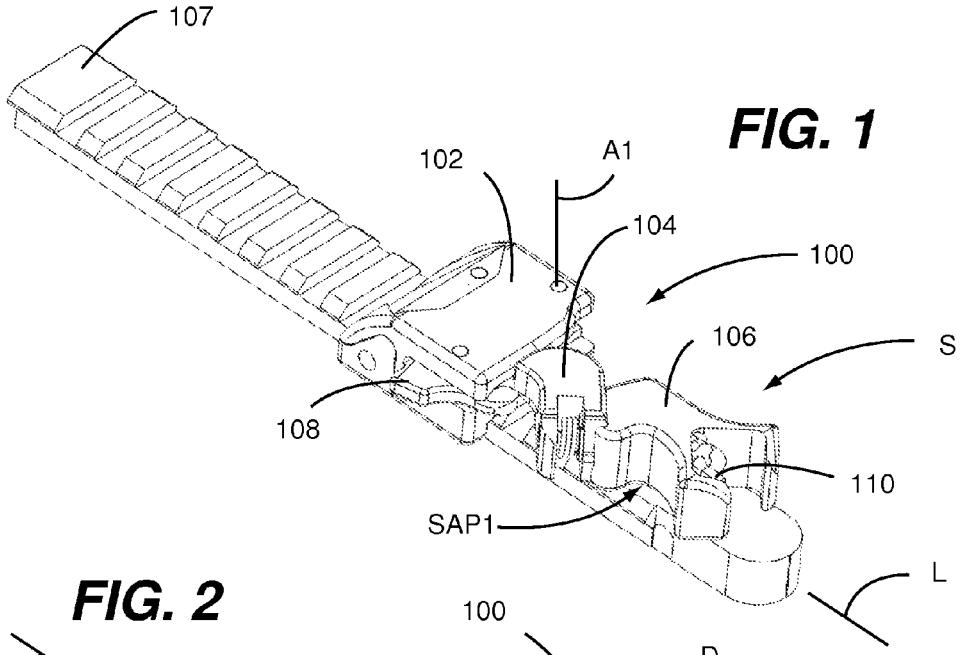
FIG. 1 is a perspective view showing a first embodiment of a double articulating targeting device configured in accordance with the present invention in a stowed orientation with respect to an accessory rail.

An articulating targeting device configured in accordance with the present invention can be used in either or both a front or rear position of a firearm (i.e., a weapon). Advantgeously, the articulating targeting device solves many problems created by the escalating use of magnified and unmagnified targeting devices mounted on the top accessory rail of M4/AR-15 style rifles, as well as any hand-held or shoulder-fired firearm utilizing an accessory mounting method. The articulating targeting device is configured to be selectively translated (i.e., flipped out) from a stowed orientation in which it is locked to a deployed orientation. In the stowed position, the articulating sighting device is in a reclined position. In some embodiments, the articulating sighting device is behind, underneath, or to the side of a primary targeting device (i.e., a magnified or unmagnified targeting device) when in the stowed position. In other embodiments, the articulating sighting device can be in a different position than behind, underneath, or to the side of a primary targeting device (i.e., a magnified or unmagnified targeting device) when in the stowed position (e.g., in an articulating sighting device receiving space within a stock of the firearm). Stowing the articulating targeting device in this manner means that it is visually out of the way of the user and is less prone to being bumped or damaged, and is less of a snag hazard for the user and/or shooting partners in close confines. When needed, the articulating targeting device can be moved to the deployed orientation under spring bias or finger pressure to its deployed orientation to a side of the primary (e.g., stationary) targeting device by pushing a release latch (or it could just be detented in the stowed position) and without having to move the primary targeting device out of the way. Preferably, the articulating targeting device can be manually pushed back to its stowed orientation without having to press anything to release it from its deployed orientation.

Beneficially, in the case of failure of a primary targeting device or in the case of changing conditions for the shooter, the articulating targeting device (e.g., a flip-out sight) can be immediately deployed to provide a back-up targeting device without removal of the primary targeting device, or both targeting devices can be initially deployed in order to be alternately used as desired. The later scenario of dual use may meet the needs of a shooter who concurrently requires both a primary targeting device that is mounted on an accessory rail (e.g., a magnified sight, a holographic sight, or a red dot sight) and a backup targeting device (e.g., an unmagnified iron sight for changing conditions with a viewing aperture that utilizes no optics). To this end, an articulating targeting device used in the rear position (e.g., a flip-out rear sight) will have a similarly mounted articulating targeting device in the front position (e.g., a flip-out front sight) with the articulating targeting device in the front position having an appropriate target alignment component (e.g., a post) corresponding to an aperture of the articulating targeting device used in the rear position (i.e., a target alignment component). A post and an aperture structure are examples of sight components.

Persons skilled in the shooting arts are aware that what the shooter sees in the viewing area of a firearm's front and rear sights is usually and necessarily different, and that type/shape of object or opening on the front sight that is viewed through some sort of opening or object on the rear sight is not the concern of the present inventions. In light of that fact, the disclosures made herein will refer to this sight alignment component or area, whether on a front or rear sight, by generically calling it an "aperture," without having any intent of limiting the front or rear flip-out sight(s) to use a certain style, type, and/or shape of opening or object to view a distant target (i.e. slot, notch, hole, geometric shape, cross hair, post, lolly pop, etc.). In view of the disclosures made herein, it will be understood that the support mechanism or housing for the flip-out sight's viewing alignment area can be generically referred to as an "aperture carrying body," regardless of whether it is referring to a front or rear sight, and also without any intent of limiting the flip-out sight's body or housing to be of any particular shape, style, and/or type.

Figure 2:
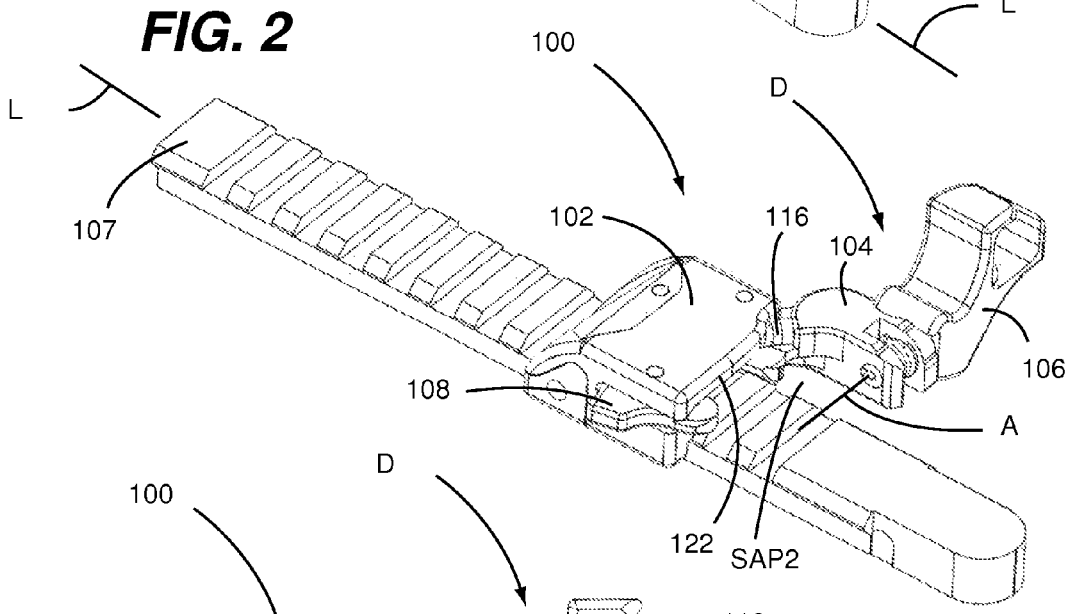
FIG. 2 is a perspective view showing the double articulating targeting device of FIG. 1 in a deployed orientation with respect to the accessory rail.
Figure 3:
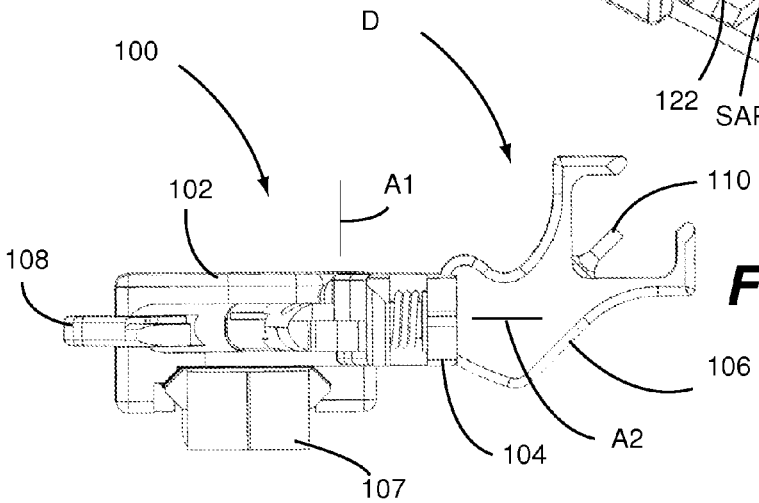
FIG. 3 is an end view showing the articulating targeting device of FIG. 1 in the deployed orientation with respect to the accessory rail.

FIGS. 1-3 show a flip out sight 100. The flip-out sight 100 is a specific implementation of an articulating targeting device configured in accordance with a first embodiment of the present invention. The flip out sight 100 includes a mounting base 102, a swing arm 104, and a sight component carrying body 106. The mounting base 102 is configured for being mounted on an accessory rail 107, which is well known to be part of a rifle (not shown) or other type of firearm or weapon. The accessory rail 107 and a similarly configured portion of a firearm receiver are examples of a support structure to which the mounting base 102 can be mounted. The mounting base 102 and the accessory rail 107 have mating engagement interfaces that allow the mounting base 102 to be displaced along a length of the accessory rail in a manner maintaining substantially precision alignment between the mounting base 102 and the accessory rail 107.

The sight component carrying body 106 is pivotally mounted on the swing arm 104 and the swing arm 104 is pivotably mounted on the mounting base 102. The swing arm 104 can pivot about a first pivot axis A1 and the sight component carrying body 106 can pivot about a second pivot axis A2. In this regard, the swing arm 104 and associated pivot structures are jointly an example of an articulation structure that enables movement of the sight component carrying body 106 with respect to two axes. As will be discussed below in greater detail, rotation of the swing arm 104 about the first pivot axis A1 and rotation of the sight component carrying body 106 about the second pivot axis A2 allows the swing arm 104 and the sight component carrying body 106, which jointly comprise an articulating assembly that is movable from a stowed orientation S (FIG. 1) with respect to the mounting base 102 to a deployed orientation D (FIGS. 2 and 3) with respect to the mounting base 102. Depression of a release member 108 allows the sight component carrying body 106 to move from the stowed position S to the deployed orientation D.

As shown in FIGS. 1-3, the first pivot axis A1 (i.e., axis one) is structured such that the articulating assembly (i.e., the swing arm 104 and sighting component carrying body 106 attached thereto) pivots around the first pivot A1 axis so that the articulating assembly can be moved (e.g., swung) back and forth between the stowed orientation S and the deployed orientation D. The swing arm 104 is in a first swing arm position SAP1 when the articulating assembly is in the stowed orientation S and is in a second swing arm position SAP2 when the articulating assembly is in the deployed orientation D. A swing arm retaining mechanism, which comprises the release member 108, secures the swing arm 104 in the first swing arm position SAP1 and enables selective release of the swing arm 104 for allowing it to move to the second swing arm position SAP2. The second pivot axis A2 (i.e., axis two) is turned approximately at a right angle from the first pivot axis A1, and is in a generally horizontal plane that extends parallel to a longitudinal axis L of the accessory rail 107. The longitudinal axis L of the accessory rail 107 extends substantially parallel to a longitudinal axis of a barrel of the firearm. The second pivot axis A2 is oriented approximately 45 degrees to the longitudinal axis L of the accessory rail 107 when the articulating assembly is in the stowed orientation S, although though this orientation could vary substantially, and is approximately perpendicular to the longitudinal axis L of the accessory rail 107 when the articulating assembly is in the deployed orientation D. Furthermore, it can be seen that the first pivot axis A1 is fixed, the second pivot axis A2 is movable between a first position corresponding to the stowed orientation S and a position corresponding to the deployed orientation D, and the second pivot axis A2 remains in a plane substantially perpendicular to the first pivot axis A1 during pivoting of the articulating assembly about the first pivot axis A1.

Figure 4:
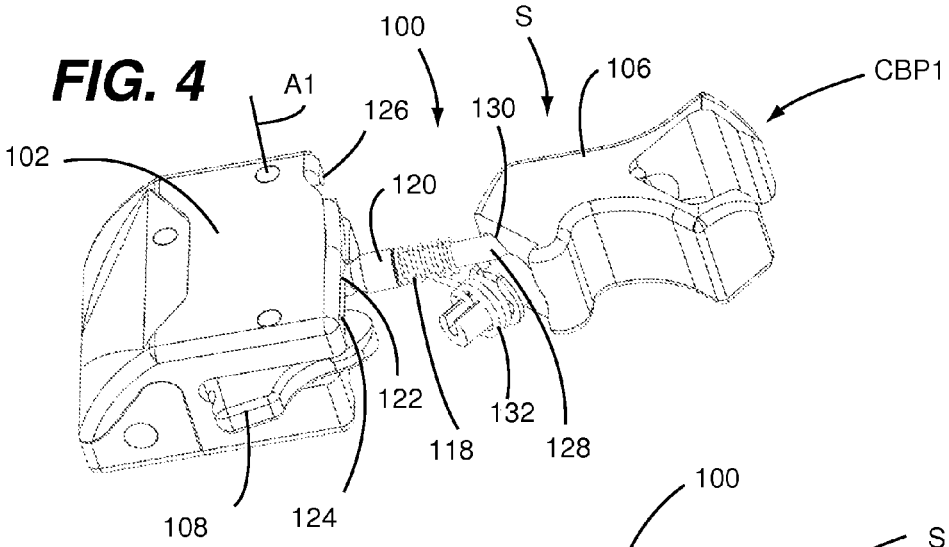
FIG. 4 is first partially invisible view (invisible swing arm) showing the articulating targeting device of FIG. 1 in the stowed orientation.
Figure 5:
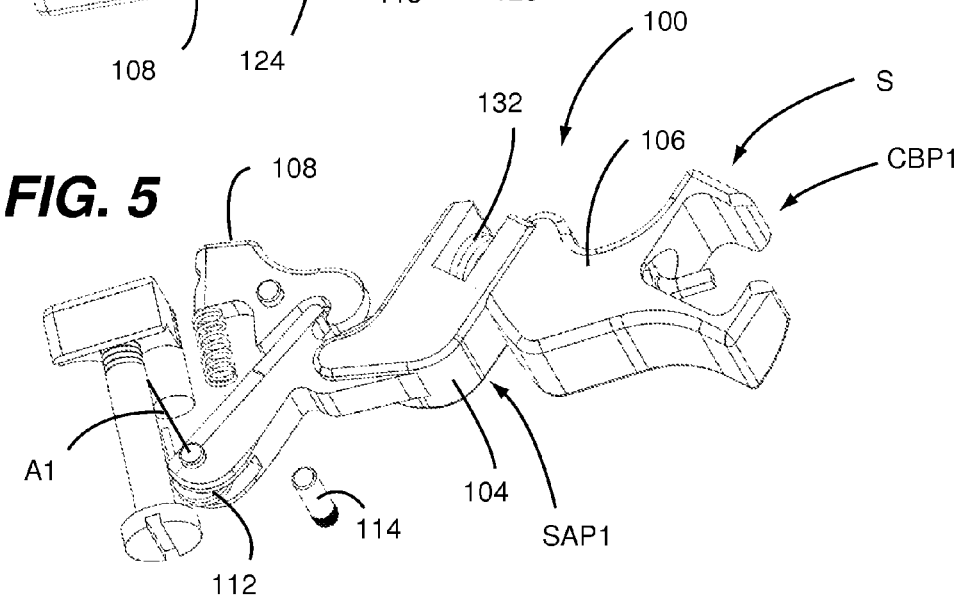
FIG. 5 is second partially invisible view (invisible mounting base) showing the articulating targeting device of FIG. 1 in the stowed orientation.

As shown in FIGS. 4 and 5, rotation (i.e., movement) of the swing arm 104 about the first pivot axis A1 can be spring assisted via a spring 112 (i.e., a swing arm biasing member) in response to depression of the release member 108. The spring 112 is shown as being a torsion spring that is coiled around the first pivot axis A1 and has opposing end portions engaged between the mounting base 102 and the swing arm 104. If spring assisted, in response to depressing the release member 108, this will cause the sight component carrying body 108 to swing toward and then past the rear of the accessory rail 107 and outward in a lateral manner about the generally vertical pivot of the first pivot axis A1, which is generally perpendicular to the longitudinal axis L of the accessory rail 107. After the swing arm 104 rotates (i.e., moves) about 45 degrees about the first pivot axis A1, the swing arm 104 comes into contact with a dowel pin or other mechanical stop 114 to stop its movement.

Figure 6:
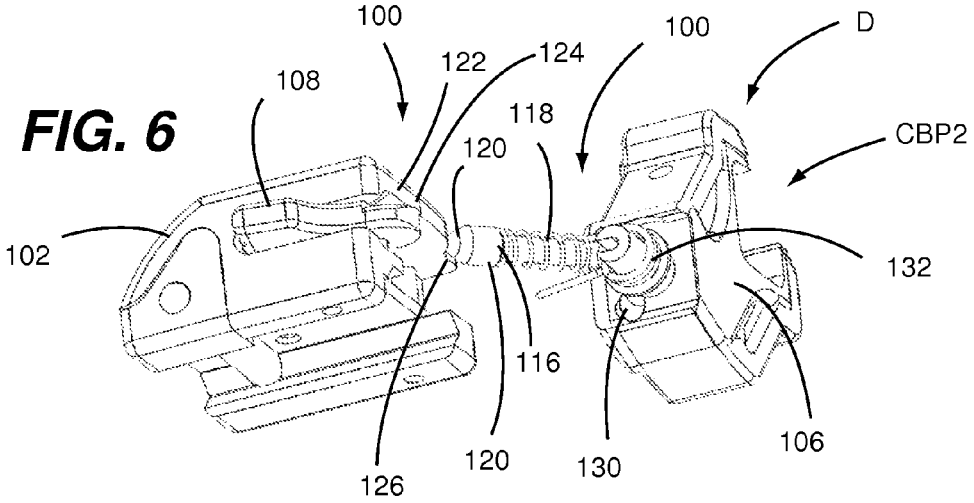
FIG. 6 is third partially invisible view (invisible swing arm) showing the articulating targeting device of FIG. 1 in the deployed orientation.

As shown in FIGS. 4-6, a cam follower 116 is slideably disposed within a passage of the swing arm 104. The cam follower 116 is spring biased via a spring 118 (i.e., a cam follower biasing member) such that a first end portion 120 of the cam follower 116 stays in contact with a cam surface 122 of the mounting base 102 as the articulating assembly moves between the stowed orientation O and the deployed orientation D. The cam surface 122 has a first portion 124 (e.g., a dwell portion) and a second portion 126 (e.g., a contoured portion). A second end portion 128 of the cam follower 116 is engaged within a recess 130 of the sight component carrying body 106 when the first end portion 120 of the cam follower 116 is engaged with the first portion 124 of the cam surface 122. When the first end portion 120 of the cam follower 116 reaches the second portion 126 of the cam surface 122, the profile of the second portion 126 of the cam surface 122 causes the cam follower 116 to translate away from the sight component carrying body 106 such that the second end portion 128 of the cam follower 116 becomes disengaged from within the recess 130 of the sight component carrying body 106. The sight component carrying body 106 is in first carrying body position CBP1 when the articulating assembly is in the stowed orientation S. Disengagement of the second end portion 128 of the cam follower 116 from within the recess 130 allows the sighting device carrying body 106 to pivot about the second pivot axis A2 such as via spring bias by a spring 132 (i.e., a carrying body biasing member) and move from the first carrying body position CBP1 to a second carrying body position CBP2 when the articulating assembly is in the deployed orientation D. Thus, the sight component carrying body 106 swings upward under spring pressure to an angled orientation somewhere between horizontal and vertical. In this regard, the cam follower 116, the cam surface 122 and the recess 130 jointly define a rotation inhibiting structure that selectively inhibits rotation of the sight component carrying body 106. The target viewing area on the sight component carrying body is then at a desirable position for aiming at the side of the primary targeting device, which would otherwise be blocking the vision of the shooter.

FIGS. 7-11 show a flip out sight 200 that is a specific implementation of an articulating targeting device configured in accordance with a second embodiment of the present invention. The flip out sight 200 of FIGS. 7-11 and the flip out sight 100 of FIGS. 1-6 have the same underlying functionality in regard to the manner in which they articulate. Specifically, both of these flip sight embodiments have a dual axis arrangement that provides for such articulation. Furthermore, the major physical elements of the flip out sight 200 of FIGS. 7-11 and the flip out sight 100 of FIGS. 1-6 are the same. As such, the following discussion of the flip out sight 200 of FIGS. 7-11 uses similar reference numbers to those used above in the discussion of the flip out sight 100 of FIGS. 1-6.

The flip out sight 200 includes a mounting base 202, a swing arm 204, and a sight component carrying body 206. The mounting base 202 is configured for being mounted on an accessory rail 107, which is well known to be part of a rifle (not shown) or other type of firearm or weapon. The accessory rail 107 and a similarly configured portion of a firearm receiver are examples of a support structure to which the mounting base 202 can be mounted. The mounting base 202 and the accessory rail 107 have mating engagement interfaces that allow the mounting base 202 to be displaced along a length of the accessory rail in a manner maintaining substantially precision alignment between the mounting base 202 and the accessory rail 107.

The sight component carrying body 206 is pivotally mounted on the swing arm 204 and the swing arm 204 is pivotably mounted on the mounting base 202. The swing arm 204 can pivot about a first pivot axis A1 and the sight component carrying body 206 can pivot about a second pivot axis A2. In this regard, the swing arm 204 and associated pivot structures are jointly an example of an articulation structure that enables movement of the sight component carrying body 106 with respect to two axes. As will be discussed below in greater detail, rotation of the swing arm 204 about the first pivot axis A1 and rotation of the sight component carrying body 206 about the second pivot axis A2 allows the swing arm 204 and the sight component carrying body 206, which jointly comprise an articulating assembly that is movable from a stowed orientation S (FIG. 7) with respect to the mounting base 202 to a deployed orientation D (FIG. 9) with respect to the mounting base 202. Depression of a release member 208 allows the sight component carrying body 206 to move from the stowed position S to the deployed orientation D (e.g., under spring biasing force).

Figure 7:
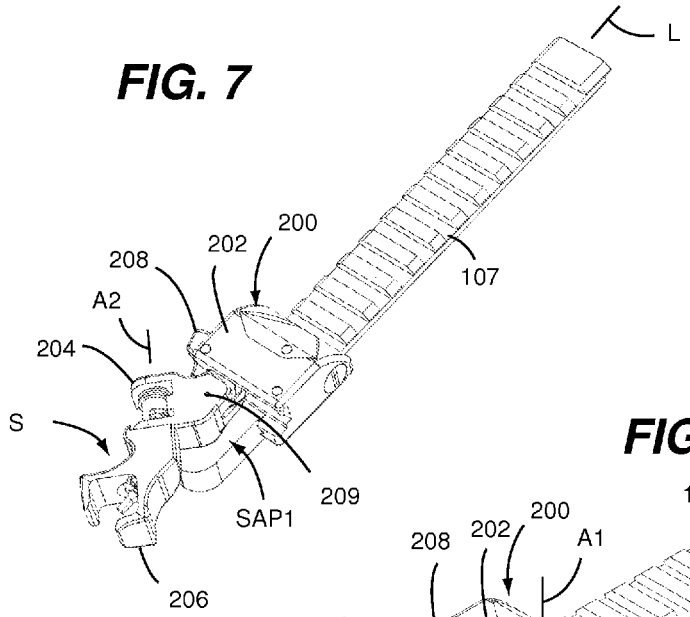
FIG. 7 is a perspective view showing a second embodiment of a double articulating targeting device configured in accordance with the present invention in a stowed orientation with respect to an accessory rail.
Figure 8:
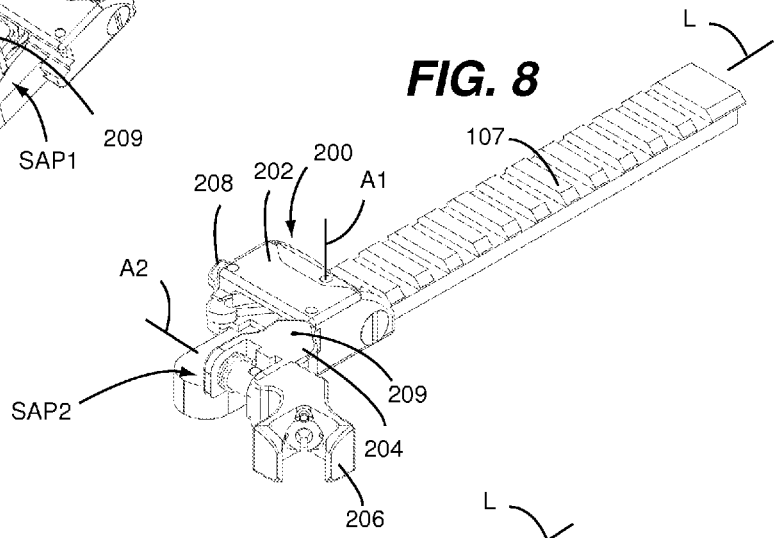
FIG. 8 is a perspective view showing the double articulating targeting device of FIG. 7 with a swing arm thereof in a pivoted orientation with respect to the accessory rail.
Figure 9:
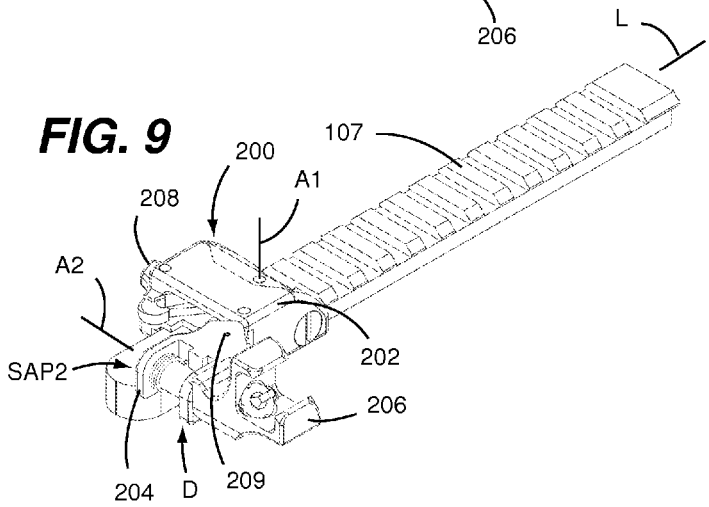
FIG. 9 is an end view showing the articulating targeting device of FIG. 7 in the deployed orientation with respect to the accessory rail.

As shown in FIGS. 7-9, the first pivot axis A1 (i.e., axis one) is structured such that the articulating assembly (i.e., the swing arm 204 and sighting component carrying body 206 attached thereto) pivots around the first pivot axis A1 so that the articulating assembly can be moved (e.g., swung) back and forth between the stowed orientation S and the deployed orientation D. The swing arm 204 is in a first swing arm position SAP1 when the articulating assembly is in the stowed orientation S and is in a second swing arm position SAP2 when the articulating assembly is in the deployed orientation D. A swing arm retaining mechanism, which comprises the release member 208, secures the swing arm 204 in the first swing arm position SAP1 and enables selective release of the swing arm 204 for allowing it to move to the second swing arm position SAP2. The second pivot axis A2 (i.e., axis two) is turned approximately at a right angle from the first pivot axis A1, and is in a generally horizontal plane that extends parallel to a longitudinal axis L of the accessory rail 107.

A key difference between the flip sight 200 of FIGS. 7-11 and the flip sight 100 of FIGS. 1-6 relates to interaction of their articulation assembly components (i.e., swing arm and sight component carrying body). In reference to the FIGS. 4-6 for the flip sight 100, the ability of the sight component carrying body 106 to rotate about the second pivot axis A2 is strictly tied to movement of the swing arm 104 via functionality of the cam follower 116 with respect to the cam surface 122 and the recess 130. For example, during movement of the articulation assembly of the flip sight 100 from the deployed orientation D to the stowed orientation S, the sight component carrying body 106 must be rotated from the second carrying body position CBP2 toward the first carrying body position CBP1 for enabling the swing arm 104 to be moved from second swing arm position SAP2 toward the first swing arm position SAP1. In contrast, as will be discussed below in greater detail in regard to the flip sight 200 of FIGS. 7-11, the ability of the sight component carrying body 206 to be rotated between the first carrier body position SAP1 and the first carrier body position SAP1 is decoupled from movement of the swing arm 204 when the swing arm 204 is in the first swing arm position SAP1. In this regard, the swing arm 204 can be returned to and latched in its first swing arm position SAP1 prior to the sight component carrying body 206 being rotated from the second carrying body position CBP2 to the first carrying body position CBP1.

Figure 10:
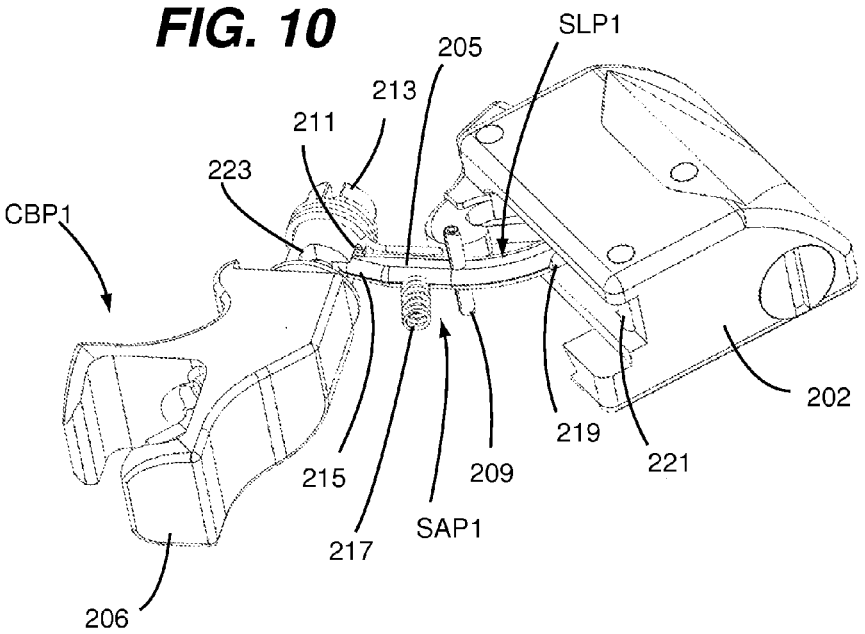
FIG. 10 is first partially invisible view (invisible swing arm) showing a swing arm lever of the articulating targeting device of FIG. 7 in a body locking position.
Figure 11:
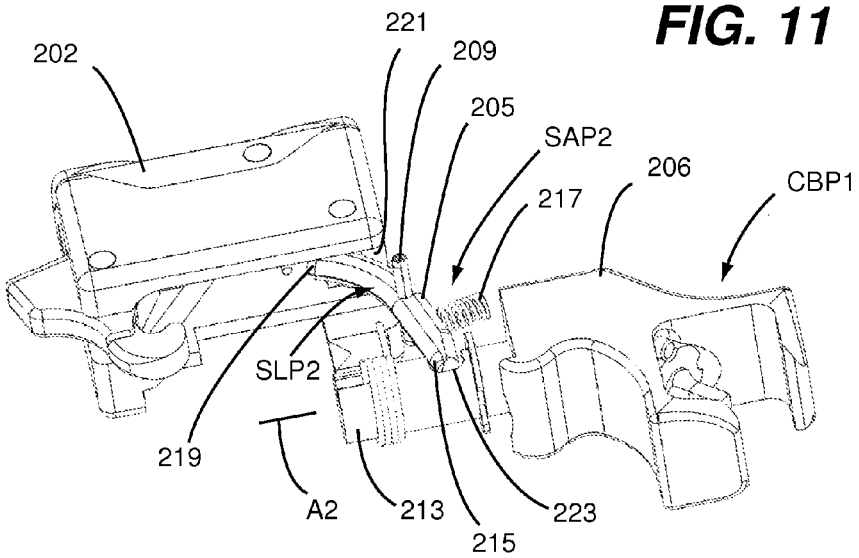
FIG. 11 is second partially invisible view (invisible swing arm) showing the swing arm lever of the articulating targeting device of FIG. 7 in a body releasing position.

As shown in FIGS. 10 and 11, a swing arm lever 205 is pivotably mounted on the swing arm 204 via a pivot pin 209. As shown in FIG. 10, when the swing arm 204 is in the first swing arm position SAP1, a first end portion 215 of the swing arm lever 205 is engaged within a undercut 211 of a barrel extension 213 of the sight component carrying body 206 when the sight component carrying body 206 is in the first carrier body position SBP1. This engagement of the swing arm lever 205 within the undercut 211 inhibits rotation of the sight component carrying body 206 from the first carrier body position SBP1 to the second carrier body position SBP2. A biasing member 215 (e.g., a spring) biases the swing arm lever 205 to a first swing arm lever position SLP1, as shown in FIG. 10. In this regard, the swing arm lever 205 and the undercut 211 of the barrel extension 213 jointly define a rotation inhibiting structure that selectively inhibits rotation of the sight component carrying body 206.

As shown in FIG. 11, movement of the swing arm 204 to the second swing arm position SAP2 causes a second end portion 219 of the swing arm lever 205 to engage a mating portion 221 of the mounting base 202. This engagement of the swing arm lever 205 with the mating portion of the mounting base 202 causes the swing arm lever 205 to pivot from the first swing arm lever position SLP1 to a second swing arm lever position SLP2 thereby causing the first end portion 215 of the swing arm lever 205 to become disengaged from within the undercut 211 of the barrel extension 213 of the sight component carrying body 206 (e.g., becoming positioned within a bypass slot 223 of the barrel extension 213). With the first end portion 215 of the swing arm lever 205 disengaged from within the undercut 211 of the barrel extension 213 of the sight component carrying body 206, the sight component carrying body 206 can be freely pivoted between the first carrying body position CBP1 and second carrying body position CBP2. For example, the sight component carrying body 206 can moved under spring biasing from the first carrying body position CBP1 to the second carrying body position CBP2 in conjunction with the swing arm 204 being pivoted from the its first swing arm position SAP1 toward the second swing arm position SAP2 and can be manually moved from the second carrying body position CBP2 to the first carrying body position CBP1 after the swing arm 204 is returned to and latched in the first swing arm position SAP1.

Another significant innovation of an articulating targeting device configured in accordance with the present invention is that it utilizes two pivot axes on an intermediate body (e.g., the swing arm) between the mounting base and the sighting component carrying body thereby enabling precise placement of the articulating assembly to the side of the primary targeting device to be attained without interfering with or hitting the primary targeting device during deployment of the articulating targeting device. An articulating targeting device that utilizes only a single pivot axis would have limited utility because it could not be constructed to accomplish the primary goals of the present invention (e.g., lay flat on the accessory rail when in the stowed orientation and also be angled to the side of the primary targeting device when deployed for use). Also, a single pivot axis would make the sight more prone to damage when deployed for use because a full range of movement would not be allowed in comparison to an articulating targeting device configured with two pivot axes.

A post 110 is shown mounted on the sight component carrying body 106. In this regard, the sight component carrying body 106 is a post carrying body, which would typically correspond to the flip-out sight 100 being used at a front sight position on a firearm. Alternatively, the sight component carrying body 106 can carry an aperture structure, which would typically correspond to the flip-out sight 100 being used at a rear sight position on a firearm.

A primary benefit of the use of at least one articulating targeting device configured in accordance with the present invention (e.g., an instance of the flip-out sight 100 used at the rear sight position and/or also at a front sight position) is that it is designed to match the shooting styles of military and law enforcement personnel who are, for example, trained in the use of the M4/AR-15 rifle platform. Using the flip-out sight does not require the shooter to change anything about their shooting profile or stance, except to rotate the rifle on its longitudinal axis (i.e., extending lengthwise along the center of the barrel of the firearm 107) until the target alignment area on the flip-out sight comes into view. In a preferred embodiment of the flip-out sights, the flip-out sights are deployed to the right side of a primary targeting device for right-handed shooters, and vice versa for left-handed users. For a right-handed shooter, for example, this movement will be counter-clockwise until the primary targeting device is roughly between the 10:00 and 11:00 position (if the flip-out sights flip out to the right side of the primary targeting device). The flip-out sights are angled so that when the firearm is rotated slightly, the sight component carrying body of each flip-out sight is upright (e.g., an aperture of an aperture structure mounted on the sight component carrying body is located at the same height from the barrel's bore as are other standard sights thereof).

As can be seen, an articulating targeting device configured in accordance with the present invention allows a sighting component carrying body thereof to change positions from generally horizontal to tilted as a result of the angulated manner in which a sighting component carrying body thereof rotates about a respective pivot axis. The tilted attach point on the sighting component carrying body allows the sighting component carrying body to recline on its back face (i.e., its back) on an accessory rail to which a mounting base of the articulating targeting device is mounted when an articulating assembly of the articulating targeting device is in the stowed orientation. When released from the stowed orientation, the articulating assembly can swing outward about a first pivot axis thereby allowing the sighting component carrying body to rotate about a second pivot axis to its an angled final position for targeting and shooting (i.e., the deployed orientation). A preferred embodiment of the articulating targeting device utilizes torsion springs (i.e., biasing members) at both pivot axes to move the sighting component carrying body into its final in-use position with no assistance from the shooter, except for the initial depression on a release member to release the articulating assembly from its stowed orientation.

In view of the disclosures made herein, a skilled person will appreciate that an articulating targeting device configured in accordance with the present invention encompasses (i.e., comprises) a mounting base that is attached in some stationary manner to a mounting portion (e.g., an accessory rail) of a firearm or other type of weapon. A swing arm is attached between the mounting base and a sighting component carrying body (e.g., an aperture carrying body) for the target alignment viewing areas on both front and rear sights as implemented in accordance with the present invention. In a stowed orientation, the swing arm and sighting component carrying body (i.e., the articulating assembly) are locked in a somewhat folded or reclining orientation in relation to the mounting base. In this stowed orientation, the swing arm is roughly oriented crosswise (e.g., skewed) to a longitudinal axis of a firearm barrel (or other longitudinal discharge axis of a weapon) and the sighting component carrying body is somewhat aligned (e.g., longitudinally) with the firearm's barrel. This stowed (and locked) orientation of the articulating assembly limits (e.g., prevents) movement of the swing arm and sighting component carrying body. When a locking member (i.e., a lock) on the mounting base is released by pushing a release member on the mounting base, the swing arm and sighting component carrying body can be moved to respective positions such that the sighting component carrying body is upright and angled to the side of the firearm (i.e., a deployed/in-use position/orientation). Once in the deployed/in-use position, the swing arm is somewhat pointed to the rear of the firearm and the sighting component carrying body is angled to one side of vertical so that it is possible to see around a primary targeting device.

In use, preferred embodiments of an articulating targeting device configured in accordance with the present invention will place a line of sight of a shooter of a firearm on which the articulating targeting device is mounted on some radial from the center of a bore of the firearm barrel in order for windage and elevation adjustments to be accurate. More specifically, this means that if imaginary x, y, and z axes are used to represent the orientation of the target alignment viewing areas on the front and rear sights, the axes would be arranged as follows: the rear sight's y axis would be the radial extending from the center of the barrel, the x axis would serve as the axis for the windage screw on the rear sight (perpendicular to the radial), and the z axis would be parallel to the longitudinal axis of the barrel. For the front sight, the y axis would also be both the radial extending from the center of the barrel and would also serve as the axis for the elevation screw, the x axis would be perpendicular to both the radial and to the longitudinal axis of the barrel, and the z axis would be parallel to the longitudinal axis of the barrel.

An alternative embodiment of the current invention would not utilize springs to move the articulating assembly from the stowed, locked orientation into the deployed orientation. Instead, such an embodiment that does not involve orientation biasing springs would require using manual force from a shooter. Manual operation of the articulating assembly without spring-assist can be a desirable embodiment in a situation when silence and stealth is required. However, a no-spring embodiment would require a retention device (e.g., latch, ball detent, thumbscrew, snap-into-place mechanism, etc) to hold the articulating assembly in its deployed orientation.

In another embodiment, an upper portion of the sight component carrying body can slide out to the side of the mounting base and then rotate up into the targeting (i.e., shooting) position that corresponds to the deployed orientation. Still another embodiment would provide for the sighting component carrying body to fold down to the side of accessory rail using either a single or double axis folding mechanism, so that the articulating assembly does not flip out, but generally is raised up and out into the deployed orientation. Yet another embodiment would provide for movement of the sighting component carrying body to be accomplished by use of one or two ball joints with stops or detents, which would allow for movement between its position corresponding to the stowed orientation and its position corresponding to the deployed orientation with or without the use of one or more springs, latches, or detents to retain the sight component carrying body in its respective positions.

In preferred embodiments, the articulating targeting device would be configured for enabling the sighting component to be adjustable for windage, for elevation, or both. Alternatively, the articulating targeting device can be configured in a non-adjustable manner whereby the sighting component carrying body simply folds down (e.g., against the accessory rail) so as to stow more compactly and to prevent the snag-hazard of having a sight protruding out to the side of the weapon. Any embodiments of an articulating targeting device configured in accordance with the present invention can be mounted permanently as part of a weapon, either onto an accessory rail thereof or onto a side or top portion of the weapon. These alternate embodiments disclose various examples of means for enabling displacement of an intermediate body with respect to a mounting base and/or means for enabling selective displacement of a sighting component carrying body that is coupled between the intermediate body and the sighting component carrying body.

An important aspect of an articulating targeting device configured in accordance with the present invention is that it allows optimum use of the limited space on a rifle's accessory rail. A preferred embodiment of the present invention has a combined/monolithic mounting base (i.e., a base mount) for both the primary targeting device and the articulating targeting device. In this manner, the two targeting devices would not compete for space on the accessory rail and would not interfere with each other's use. Such a combined/monolithic mounting base could be manufactured generically to meet the size requirements of a variety of sights, or alternately could be manufactured specifically to fit only one primary targeting devices and the articulating targeting device so that no interference between the two targeting devices would result while the smallest amount of space and weight is used. Utilizing a combination mounting base for both the primary and articulating targeting devices allows movement of the articulating targeting device to the rearmost position on an accessory rail so that the articulating targeting device can be suspended beyond a back portion (rear end) of the accessory rail and consumes minimal or no rail space. Such an orientation meets the needs of shooters that like to have targeting sights very close to their eye.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. An articulating targeting device, comprising:

a mounting base;

a swing arm pivotably attached to the mounting base for allowing the swing arm to pivot about a first pivot axis between a first swing arm position and a second swing arm position; and a sighting component carrying body pivotably attached to the swing arm for allowing the sighting component carrying body to pivot about a second pivot axis between a first carrying body position and a second carrying body position;

wherein the first pivot axis extends substantially perpendicular to the second pivot axis;

wherein the first pivot axis extends substantially perpendicular to a direction of travel of the mounting base when an engagement interface of the mounting base is engaged with a mating engagement of a support structure; and wherein the second pivot axis is skewed with respect to the direction of travel of the mounting base when the swing arm is in the first swing arm position and is substantially parallel to the direction of travel of the mounting base when the swing arm is in the second swing arm position.

2. The articulating targeting device of claim 1 wherein movement of the sighting component carrying body from the first carrying body position to the second carrying body position is enabled by movement of the swing arm from the first swing arm position toward the second swing arm position.

3. The articulating targeting device of claim 1 wherein:

the swing arm is secured in the first swing arm position through engagement with a swing arm retaining mechanism that allows the swing arm to be selectively released therefrom for enabling movement from the first swing arm position toward the second swing arm position;

the sighting component carrying body is secured in the first carrying body position when the swing arm is in the first swing arm position;

movement of the swing arm from the first swing arm position toward the second swing arm position enables the sighting component carrying body to be moved from the first carrying body position to the second carrying body position; and the swing arm and the sighting component carrying body are jointly in a deployed orientation when swing arm is in the second swing arm position and the sighting component carrying body is in the second carrying body position.

4. An articulating targeting device, comprising:

a mounting base;

a swing arm pivotably attached to the mounting base for allowing the swing arm to pivot about a first pivot axis between a first swing arm position and a second swing arm position;

a sighting component carrying body pivotably attached to the swing arm for allowing the sighting component carrying body to pivot about a second pivot axis between a first carrying body position and a second carrying body position;

a rotation inhibiting structure coupled between the swing arm and the sighting component carrying body for securing the sighting component carrying body in a first sighting component carrying body position while the swing arm is in a first swing arm position and enabling the sighting component carrying body to be moved from the first sighting component carrying body position to a second-sighting component carrying body position in response to the swing arm moving from the first swing arm position to a second swing arm position;

a swing arm biasing member resiliently biasing the swing arm toward the second swing arm position; and a carrying body biasing member resiliently biasing the sighting component carrying body toward the second carrying body position.

5. The articulating targeting device of claim 4 wherein:

the first pivot axis extends substantially perpendicular to the second pivot axis;

the first pivot axis extends substantially perpendicular to a direction of travel of the mounting base when an engagement interface of the mounting base is engaged with a mating engagement of a support structure; and the second pivot axis is skewed with respect to the direction of travel of the mounting base when the swing arm is in the first swing arm position and is substantially parallel to the direction of travel of the mounting base when the swing arm is in the second swing arm position.

6. An articulating targeting device, comprising:

a mounting base;

a swing arm pivotably attached to the mounting base for allowing the swing arm to pivot about a first pivot axis between a first swing arm position and a second swing arm position;

a sighting component carrying body pivotably attached to the swing arm for allowing the sighting component carrying body to pivot about a second pivot axis between a first carrying body position and a second carrying body position;

a swing arm biasing member resiliently biasing the swing arm toward the second swing arm position; and a carrying body biasing member resiliently biasing the sighting component carrying body toward the second carrying body position.

7. The articulating targeting device of claim 6 wherein movement of the sighting component carrying body from the first carrying body position to the second carrying body position is enabled by movement of the swing arm from the first swing arm position toward the second swing arm position.

8. An articulating targeting device, comprising:

a mounting base;

a sighting component carrying body; and an articulation structure coupling the sighting component carrying body to the mounting base, wherein the articulation structure enables the sighting component carrying body to be rotated about a first pivot axis that extends through the mounting base and enables the sighting component carrying body to be rotated about a second pivot axis that extends through the sighting component carrying body;

wherein the first pivot axis extends substantially perpendicular to a direction of travel of the mounting base when an engagement interface of the mounting base is engaged with a mating engagement of a support structure; and wherein the second pivot axis is skewed with respect to the direction of travel of the mounting base when the articulation structure is in the first swing arm position and is substantially parallel to the direction of travel of the mounting base when the articulation structure is in the second swing arm position.

9. The articulating targeting device of claim 8 wherein rotation of the sighting component carrying body about the second pivot axis is enabled by rotation of the sighting component carrying body about the first pivot axis.

10. The articulating targeting device of claim 8 wherein:

an intermediate body of the articulation structure is secured in a first position through engagement with a retaining mechanism that allows the intermediate body to be selectively released therefrom for enabling movement from the first position toward a second position;

the sighting component carrying body is secured in a first carrying body position when the intermediate body is in the first position;

movement of the articulation structure from the first position toward the second position enables the sighting component carrying body to be moved from the first carrying body position to the second carrying body position; and the intermediate body and the sighting component carrying body are jointly in a deployed orientation when the intermediate body is in the second position and the sighting component carrying body is in the second carrying body position.

11. The articulating targeting device of claim 10, further comprising:

a rotation inhibiting structure coupled between the mounting base, the sighting component carrying body and the intermediate body;

wherein the rotation inhibiting structure inhibits rotation of the sighting component carrying body from the first carrying body position to the second carrying body position during a first portion of the movement of the articulation structure from the first position to the second position; and wherein the rotation inhibiting structure allows rotation of the sighting component carrying body from the first carrying body position to the second carrying body position during a second portion of the movement of the articulation structure from the first position to the second position.

12. An articulating targeting device, comprising:

a mounting base;

a sighting component carrying body;

an articulation structure coupling the sighting component carrying body to the mounting base, wherein the articulation structure enables the sighting component carrying body to be rotated about a first pivot axis that extends through the mounting base and enables the sighting component carrying body to be rotated about a second pivot axis that extends through the sighting component carrying body;

an intermediate body of the articulation structure is secured in a first position through engagement with a retaining mechanism that allows the intermediate body to be selectively released therefrom for enabling movement from the first position toward a second position;

a first biasing member resiliently biasing the intermediate body toward the second position; and a second biasing member resiliently biasing the sighting component carrying body toward the second carrying body position;

wherein the sighting component carrying body is secured in a first carrying body position when the intermediate body is in the first position;

wherein movement of the articulation structure from the first position toward the second position enables the sighting component carrying body to be moved from the first carrying body position to the second carrying body position; and wherein the intermediate body and the sighting component carrying body are jointly in a deployed orientation when the intermediate body is in the second position and the sighting component carrying body is in the second carrying body position.

13. An articulating targeting device, comprising:

a mounting base;

a sighting component carrying body; and an articulation structure coupling the sighting component carrying body to the mounting base, wherein the articulation structure enables the sighting component carrying body to be rotated about a first pivot axis that extends through the mounting base and enables the sighting component carrying body to be rotated about a second pivot axis that extends through the sighting component carrying body;

wherein an intermediate body of the articulation structure is secured in a first position through engagement with a retaining mechanism that allows the intermediate body to be selectively released therefrom for enabling movement from the first position toward a second position;

wherein the sighting component carrying body is secured in a first carrying body position when the intermediate body is in the first position;

wherein movement of the articulation structure from the first position toward the second position enables the sighting component carrying body to be moved from the first carrying body position to the second carrying body position;

wherein the intermediate body and the sighting component carrying body are jointly in a deployed orientation when the intermediate body is in the second position and the sighting component carrying body is in the second carrying body position;

wherein the first pivot axis extends substantially perpendicular to a direction of travel of the mounting base when an engagement interface of the mounting base is engaged with a mating engagement of a support structure; and wherein the second pivot axis is skewed with respect to the direction of travel of the mounting base when the intermediate body is in the first position and is substantially parallel to the direction of travel of the mounting base when the intermediate body is in the second position.

* * * * *